United States Patent [19]

Wentzell

[11] 4,008,023

[45] Feb. 15, 1977

[54] MOLD PACK FOR MAKING METAL POWDER ARTICLES

[75] Inventor: Joseph M. Wentzell, Remsen, N.Y.

[73] Assignee: United Technologies Corporation, Hartford, Conn.

[22] Filed: June 24, 1976

[21] Appl. No.: 699,285

Related U.S. Application Data

[63] Continuation-in-part of Ser. No. 238,411, March 27, 1972, abandoned.

[52] U.S. Cl. ..... 425/78; 425/DIG. 12; 249/61

[51] Int. Cl.[2] ..... B29C 3/00; B30B 11/00

[58] Field of Search ..... 425/78, DIG. 12, 405 H; 249/61

[56] References Cited

UNITED STATES PATENTS

| | | | |
|---|---|---|---|
| 3,112,166 | 11/1963 | Montgomery et al. | 425/405 H X |
| 3,230,286 | 1/1966 | Bobrowsky | 425/78 X |
| 3,972,662 | 8/1976 | Bird | 425/78 |

*Primary Examiner*—J. Howard Flint, Jr.
*Attorney, Agent, or Firm*—Edward J. Timmer

[57] ABSTRACT

A compactible mold pack useful for forming articles of complex inner and outer contour and substantial uniform density directly from metal powder is disclosed. The mold pack includes first and second porous, compactible mold sections defining therebetween a cavity in the outer contour of the article to be made, a porous, compactible core suspended in the cavity to define the inner contour and metal powder disposed in the cavity between the mold sections and core, the mold sections and core having an initial porosity substantially equal to that of the metal powder to be consolidated. The mold pack may be compacted to size by conventional forging and pressing techniques to consolidate the metal powder therein into the desired article.

8 Claims, 2 Drawing Figures

MOLD PACK FOR MAKING METAL POWDER ARTICLES

BACKGROUND OF THE INVENTION

This application is a continuation-in-part of application U.S. Pat. Ser. No. 238,411 filed Mar. 27, 1972, now abandoned.

FIELD OF THE INVENTION

The present invention relates to the formation of articles of use directly from metal powder.

DESCRIPTION OF THE PRIOR ART

The formation of a variety of articles by powder metallurgy techniques is well known. Usually, such techniques involve placing metal powder in a mold or die and consolidating the powder under pressure to the desired shape. Unfortunately, it is also well known that articles of complex contour are difficult to make by powder techniques with uniform density throughout. An example of this difficulty is a circular disc used to fixture turbine blades in a gas turbine engine. The turbine disc is generally thicker near the center than near the circumference and may have numerous projections for ring seals. In such a case, the thickness of the disc may vary from about one inch to about four inches or more from the circumference to the center. When such a disc is made in a pot die in conventional fashion using metal powder of assumed bulk density (or porosity) of about 50% and punches contoured to give the necessary one to four inch variable cross section, the portion of the disc represented by the one inch cross section will be compacted to near 100% of theoretical density while the four inch thick portion will be compacted to only about 60% of theoretical density. The result is, of course, a disc having undesirable density or porosity differentials and inferior mechanical properties which are cause for rejection of the disc. U.S. Pat. No. 3,467,745 illustrates a technique for forming a refractory carbide body having a shaped cavity by first cold pressing the carbide powder into an oversized body having an oversized cavity, filling the cavity with a loose mixture of removable powder and then hot pressing the oversized body and powder mixture contained therein to the desired size. After hot pressing, the powder mixture is selectively removed from the cavity to produce the finished carbide object. The method taught is disadvantageous in that it is limited to the formation of hollow bodies and requires at least two separate powder pressing steps to produce the final article. No means by which metal powder can be formed directly into an article of complex outer contour or complex inner and outer contour, such as a gas turbine disc having internal cooling passages, are provided.

U.S. Pat. No. 3,531,848 describes a technique for making rectangularly shaped metal structures having an internal cavity or hollow portion. In accordance therewith, an assembly comprising containerized metal powder having shaped mandrels embedded therein is rolled to desired thickness on a rolling mill. The mandrels may be solid, powder or partially densified powder and are removed after rolling to provide the desired internal cavities. The disclosed method is limited to the production of rectangularly-shaped, hollow metal structures having outer surfaces of a smooth, noncontoured nature; for example, the so called metal "sandwich" or "honeycomb" structures or simple structural shapes. The patent indicates that the assembly of metal powder and mandrels must be rolled to produce a structure of acceptable properties because conventional powder fabrication techniques, such as pressing and sintering, are inadequate for this purpose.

Another patent typical of the prior art is U.S. Pat. No. 3,112,166 which discloses a method for making a simple hollow tube by explosive compaction of metal powder around a deformable, cylindrical core.

In summary, the prior art fails to furnish a means by which uniformly dense articles of complex outer contour or complex inner and outer contour, such as a turbine disc having internal cooling passages, can be made directly from metal powder by conventional pressing techniques.

SUMMARY OF THE INVENTION

The present invention provides a compactible mold pack useful for making articles of complex contour directly from metal powder by conventional forging and other powder pressing techniques. Articles made with the mold pack of the invention are characterized as having uniform density throughout and precise dimensional tolerance regardless of the complexity of cross-sectional contour.

In one embodiment of the invention useful for making an article of complex inner and outer contour having substantial uniform density, the mold pack includes first and second porous, compactible mold sections in opposed working relationship to define a cavity therebetween in the general outer contour of the article to be made; a porous, compactible core suspended in the cavity to define the inner contour of the article, the core and cavity being oversized in the direction of compaction, and metal powder disposed in the cavity between the mold sections and core. The mold sections and core are expendable and have an initial porosity substantially equal to that of the metal powder to be compacted. Upon compaction of the mold pack to size by conventional means, the mold sections, core and metal powder are uniformly densified as a result of their initial, substantially equal porosities, the densified metal powder forming the desired article. Selective removal of the mold sections and core from the densified metal powder provides the desired article essentially ready for use.

The present invention is especially useful in making complex outer contoured parts having cooling passages therein, such as discs, blades, vanes and the like, for use in gas turbine engines where density differentials in the part are highly deleterious and cause for part rejection.

Other objects and advantages of the present invention will become apparent from the following drawings and detailed description of the preferred embodiment.

DESCRIPTION OF PREFERRED EMBODIMENT

Figure 1:
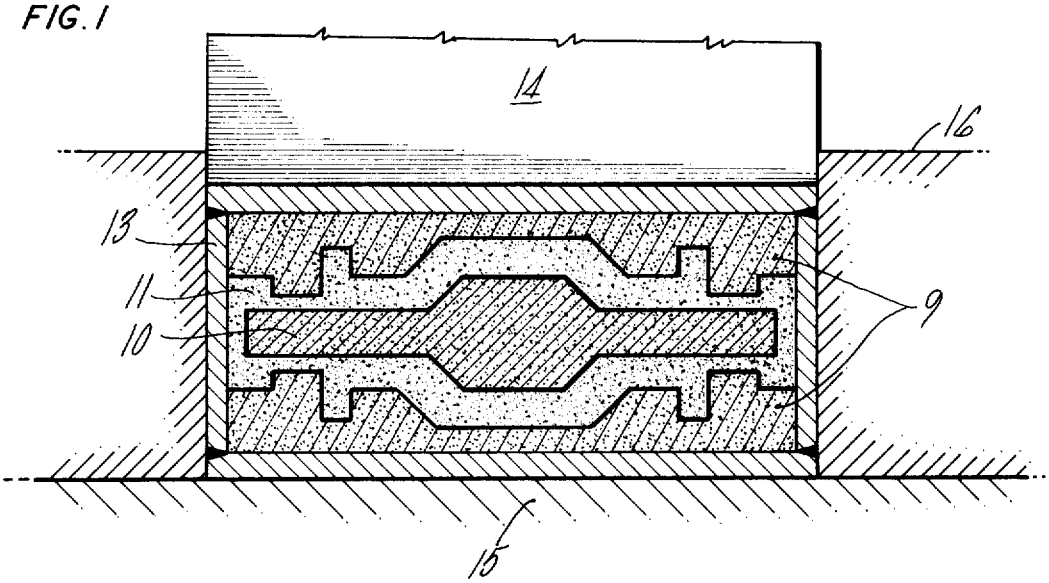
FIG. 1 is a vertical sectional view through the mold pack of the invention prior to compaction.

Although the exemplary embodiment of the invention set forth in detail below relates to the formation of a gas turbine disc having an internal cooling cavity, it is offered merely for illustration and is not intended to limit the scope of the present invention.

Referring to the figures, the mold pack is shown as including first and second porous, compactible mold sections 9 in opposed working relationship to define a cavity therebetween having the general outer contour of the disc to be made. A porous, compactible core 10 is suitably suspended in the cavity to define the contour of the internal cooling cavity to be provided in the turbine disc. In accordance with the invention, mold sections 9 and core 10 have an initial porosity substantially equal to that of the metal powder 11 to be compacted. In the example illustrated, the metal powder disposed in the cavity between the mold sections and core is a nickel base superalloy powder commonly known as IN 100 having a nominal composition 0.18%C, 10.0%Cr, 15.0%Co, 3.0%Mo, 4.7%Ti, 5.5%Al, 0.014%B, 1.0%V, balance essentially nickel and a bulk powder porosity of about 30% (or a bulk powder density of about 70%). The mold sections 9 and core 10 are provided with such porosity (about 30%) by pressing and machining them to shape from powdered iron, as discussed more fully below. Since the porous mold sections, core and superalloy powder will shrink by about 30% upon compaction to 100% of theoretical density, the cavity defined by the mold sections and the core are oversized by that amount in the direction of compaction, shown in the figures as the thickness direction. Generally, the cavity and core will be oversized by an amount equal to the bulk porosity of the powder to be compacted (or, in other words, by an amount equal to the difference between the bulk density of the metal powder to be compacted and its theoretical density).

The mold sections and core may be formed of various materials including, but not limited to, metal powders, ceramic powders, metal foam and the like. The material utilized must be expendable so that the mold sections and core may be subsequently removed from the compacted article. Also, if contamination of the metal powder is to be avoided, the mold sections and core should be made of a material which is essentially nonreactive therewith. Powdered iron has been found to be a suitable material for the mold sections and core in forming nickel base superalloy turbine discs and other articles in accordance with the invention.

The mold sections and core may be provided in the desired shapes and porosities by cold pressing, pressing and machining; investment casting, plaster casting and other conventional techniques. The powdered iron mold sections and core illustrated in the figures are conveniently formed by cold pressing iron powder disks to approximately 70% density (30% porosity), sintering at approximately 2,150° F in a reducing atmosphere furnace and then machining the sintered disks to the desired contours.

Preferably, prior to introduction of the metal powder in the cavity, the mold sections and core are surrounded by a container 13, such as the welded sheet metal can shown in the figures. The superalloy powder is thereafter introduced into the cavity between the mold sections and core in sufficient quantity to form the desired article. The container may be provided with a suitable opening through which the metal powder is poured or a portion of the side wall may be temporarily omitted for introduction of the powder therethrough. When the cavity is filled with the desired amount of powder, the container is evacuated and sealed. Preferably, the container is vibrated during introduction of the metal powder to insure uniform filling of the cavity.

Thereafter, the containerized mold pack is compacted to size by conventional powder pressing techniques including forging, hydropressing, isostatic pressing and the like.

Figure 2:
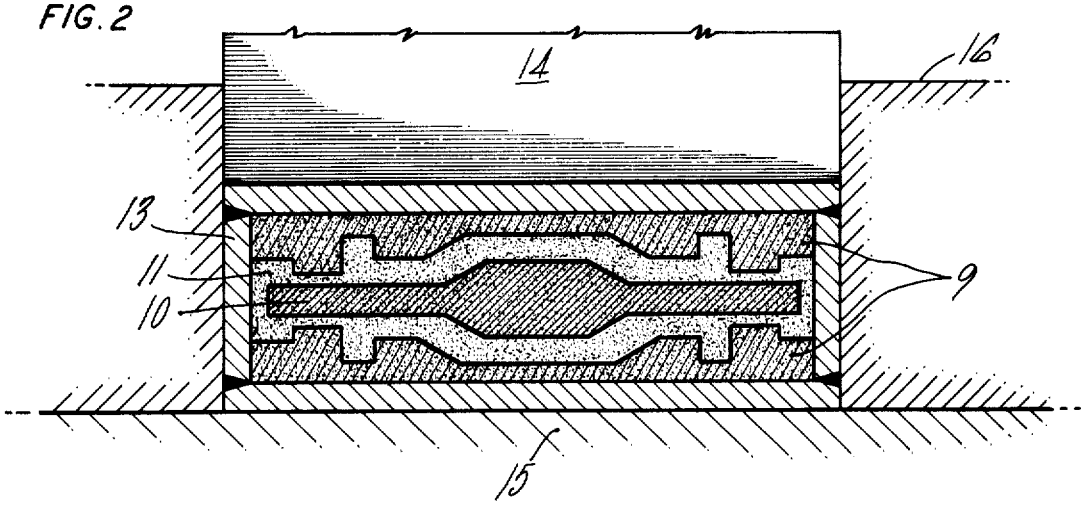
FIG. 2 is a vertical sectional view through the same mold pack after compaction.

The mold pack may be compacted in the hot or cold condition depending upon the metal powder being densified. In the case of nickel base superalloy powder, IN 100 in particular, the mold pack is preferably heated to approximately 2,150° F. and then placed between punches 14 and 15 of pot die 16 and forged or pressed, to near 100% of theoretical density, the compacted mold pack being shown in FIG. 2. Upon compaction of the mold pack to size, the mold sections, core and metal powder are uniformly densified as a result of their initial, substantially equal porosities, each component being densified by about 30% to a final density near 100% of theoretical. In this way, the metal powder is formed into the disc having the desired complex inner and outer contour and substantial uniform density throughout. It is thus essential to the present invention that the mold sections, core and metal powder have initial, substantially equal porosities to insure uniform densification upon compaction.

After pressing, the container, mold sections and core are removed from the densified metal powder to provide the desired article which is ready for use, except for possible minor machining, conditioning or the like. Usually, only minimal machining is required since the articles produced in the mold pack are not only uniformly densified but also dimensionally accurate. The container, mold sections and core may be removed by conventional methods, such as machining, pickling, leaching and the like.

Of course, those skilled in the art will recognize that core 10 may be omitted from the mold pack if the article to be made does not include an inner contour, such as an internal cavity or the like. In this situation, the mold pack would comprise first and second porous, compactible mold sections which define a cavity therebetween in the precompaction shape of the article to be made and metal powder disposed in the cavity. Those skilled in the art will also recognize that the metal powder may be pressed to less than 100% of theoretical density in the mold pack if desired; for example, in forming an article having a preselected porosity to accept lubrication. Of course, other changes, omissions and additions in the form and detail of the preferred embodiment may be made without departing from the spirit and scope of the invention.

Having thus described typical embodiments of my invention, that which I claim as new and desire to secure by Letters Patent of the United States is:

1. A mold pack for making an article of complex inner and outer contour and substantial uniform density directly from metal powder comprising: first and second porous, compactible mold sections in opposed working relationship to define a cavity therebetween having the general outer contour of the article to be made, a porous, compactible core suspended in said cavity to define the general inner contour of said article, the cavity and core being oversized in the direction of compaction, the mold sections and core being expendable and having an initial porosity substantially equal to that of the metal powder to be compacted so that the mold sections, core and metal powder are uniformly densified when the mold pack is compacted to size, the densified metal powder forming the desired article.

2. The mold pack of claim 1 wherein the cavity and core are oversized by an amount equal to the bulk porosity of the metal powder to be compacted.

3. The mold pack of claim 1 wherein the mold sections and core are made of metal powder.

4. The mold pack of claim 1 wherein the mold sections and core define a cavity in the shape of a gas turbine engine disc having an internal cooling passage.

5. A mold pack for making an article of complex outer contour and substantial uniform density directly from metal powder comprising:

first and second porous, compactible mold sections in opposed working relationship to define a cavity therebetween having the general outer contour of the article to be made, the cavity being oversized in the direction of compaction, the mold sections being expendable and having an initial porosity substantially equal to that of the metal powder to be compacted so that the mold sections and metal powder are uniformly densified when the mold pack is compacted to size, the densified metal powder forming the desired article.

6. The mold pack of claim 5 wherein the cavity is oversized by an amount equal to the bulk porosity of the metal powder to be compacted.

7. The mold pack of claim 5 wherein the mold sections are made of metal powder.

8. The mold pack of claim 5 wherein the mold sections define a cavity in the shape of a gas turbine engine disc.

* * * * *